US007828462B2

(12) United States Patent
Jensen et al.

(10) Patent No.: US 7,828,462 B2
(45) Date of Patent: Nov. 9, 2010

(54) IMITATION CANDLE WITH SIMULATED LIGHTED WICK USING EXTERNAL LIGHT SOURCE

(76) Inventors: Bradford B. Jensen, 1350 Lupine Dr., Saint Joseph, MI (US) 49085; Roger D. Bentley, 6675 Weatherford Dr., Coloma, MI (US) 49038; Kim I. McCavit, 2361 S. Cleveland Ave., Saint Joseph, MI (US) 49085

( * ) Notice: Subject to any disclaimer, the term of this patent is extended or adjusted under 35 U.S.C. 154(b) by 507 days.

(21) Appl. No.: 11/401,139

(22) Filed: Apr. 10, 2006

(65) Prior Publication Data

US 2007/0236947 A1 Oct. 11, 2007

(51) Int. Cl.
*F21V 35/00* (2006.01)
*F21V 21/00* (2006.01)

(52) U.S. Cl. ..... 362/249.02; 362/249.06; 362/392; 362/810

(58) Field of Classification Search ..... 362/392, 362/393, 447, 810, 251, 184, 800, 394, 569, 362/124, 276, 811, 806, 808, 410, 414, 249.02, 362/249.06
See application file for complete search history.

(56) References Cited

U.S. PATENT DOCUMENTS

| | | | | |
|---|---|---|---|---|
| 5,924,784 | A * | 7/1999 | Chliwnyj et al. | 362/234 |
| 7,422,355 | B2 * | 9/2008 | Hirata | 362/565 |
| 2002/0080605 | A1 * | 6/2002 | Starry | 362/205 |
| 2005/0047127 | A1 | 3/2005 | Tutman | |
| 2005/0254232 | A1 | 11/2005 | Bentley et al. | |
| 2005/0254248 | A1 * | 11/2005 | Lederer | 362/392 |

FOREIGN PATENT DOCUMENTS

| | | | |
|---|---|---|---|
| DE | 20 2005 008 9004 | U1 | 11/2005 |
| WO | WO 96/25624 | | 8/1996 |
| WO | WO 2005031208 | A1 * | 4/2005 |
| WO | WO 2006/020839 | A2 | 2/2006 |

OTHER PUBLICATIONS

English Translation (Claims, Detailed Description) of Japanese Publication WO 2005/031208 A1.*
http://www.nam.lighting.philips.corn/us/ssl/display.php?mode=1.
http://store.igiftsfast.com/2wax.html.
http://www.norexbuydirect.com/candle.htm.
http://store.Isgc.com/LED-VOTIVE-CANDLE-SET-P3C3.aspx.

(Continued)

*Primary Examiner*—Thomas M Sember
(74) *Attorney, Agent, or Firm*—Paul W. O'Malley; Susan L. Firestone

(57) ABSTRACT

A decorative, imitation candle effectively simulates a lighted wick in a darkened environment by location of a light source at the tip of an imitation wick. The light source is provided by an LED located at the tip of the wick for direct viewing in order to obtain maximum brightness and high contrast to an observer in a darkened environment. The light source and its support structure are incorporated into the imitation wick so that they do not detract from the imitation candle's realism when the imitation candle is viewed from the side or from above under higher ambient lighting.

20 Claims, 10 Drawing Sheets

OTHER PUBLICATIONS http://www.epartyunlimited.com/led-candles.html.
http://www.ledtronics.com/ds/led-candle-001/default.asp.
http://www.inspiredlighting.com/index.asp?PageAction=VIEWPROD&ProdID=....
http://www.greatideas.ws/products_candle.htm.
http://www.brookstone.com/shop/thumbnail.asp?world_code=2&category_code=....
International Search Report.
International Written Opinion of ISA.

* cited by examiner

IMITATION CANDLE WITH SIMULATED LIGHTED WICK USING EXTERNAL LIGHT SOURCE

BACKGROUND OF THE INVENTION

1. Technical Field

The invention relates to decorative, imitation candles and, more particularly, to an imitation candle simulating a lighted wick.

2. Description of the Problem

Numerous manufacturers have attempted to meet a demand for a flameless, candle like luminary using electrical illumination. There are many imitation candles available that use incandescent lamps or LEDs as a light source. These devices address people's concern with having an open flame indoors. Most of these devices try to implement the appearance of a realistic flame using a specially shaped bulb or lens that is exposed to view. Typically, the bulb or lens sits on top of a thin cylindrical sleeve, which is shaped and colored to resemble a candle. The results are typically disappointing, especially when these devices are not illuminated. The visible, flame shaped artificial light source draws attention to the fact that the device is an imitation candle. The result can look more like a caricature of a candle than a real candle. The color of incandescent light can leave something to be desired in many candles as well.

In addition, there are also imitation candles available that utilize one or more very small incandescent lamps or LEDs as the light source which do not place the light source inside a flame shaped structure. Examples exist of imitation candles which have a deep well on the top to simulate a candle that has been burning for some time. As these light sources are relatively small they can be concealed within the deep well of the artificial candle. From most viewing angles, the wall of the artificial candle would be between the light source and the viewers eye. At these viewing angles there is no artificial flame structure visible that would detract from the candle's realism. However, when viewed from above, the small light source (or sources) are readily visible and reveal that the candle is an imitation. It would be desirable to provide an imitation candle that is viewable from the side or above without revealing an obvious artificial light source.

A key visual element of a real flame is a rather intense area of light. When the flame is viewed directly, in a darkened environment, the flame can become a source of glare for an eye accommodated to scotopic vision. Eyes adjusted to darkness cannot tolerate the large contrast in brightness and as a result, the physical outline of the flame is often lost to the eyes in the glare. In the case of artificial flame structures, the outer surface is often frosted so that the flame structure is itself lit up. By spreading the light from the artificial light source across a larger surface area, the intensity of light across the surface is much less than that from an illumination source. Because of this lack of point source intensity, the brain does not interpret the flame structure as a real flame, but still comprehends the structure. Incandescent lamps that have clear glass flame structures reveal an intense filament, but the filaments are generally linear, detracting from their appearance. The glass, though clear, may still be visible as well.

U.S. Pat. No. 6,616,308, which is incorporated herein by reference, teaches an imitation candle configured to diminish any expectation on the part of an observer of seeing an open flame. Many of the typical deficiencies found in imitation candles are addressed in the '308 patent. The flame structure is eliminated and so does not detract from the candle's realism when not illuminated. In addition, the candle's structure is such that from most viewing angles the observer would not expect to have a direct view of the flame and so the lack of a flame when illuminated does not detract from the candle's realism. When the candle is off and viewed from above, there is no visible bulb or other structure to reveal that the candle is artificial. An imitation wick, visible when the candle is viewed from above, can be used to complete the illusion that the candle is real. However, when the imitation candle of the '308 patent is on and viewed from above, there is no bright source of light at the end of the wick as would be expected in a real candle. It would be desirable to provide an artificial candle with an artificial wick that when viewed from the side or above, does not reveal an obvious light source or other structure that would reveal that the candle is artificial, while at the same time providing a bright source of light at the tip of the wick when the candle is on.

One approach to creating a realistic illusion of a flame is disclosed in U.S. patent application Ser. No. 10/844,075, filed 12 May 2004 (now U.S. Pat. No. 7,093,961 and assigned to the assignee of the present application), which is incorporated herein by reference. This application discloses an LED hidden within a fixture above an imitation candle body. Light emitted by the LED is directed to illuminate the candle body and wick from above. The LED is driven by a variable current to produce flickering light. The imitation wick has a reflective tip which reflects the incident light to create a small bright spot. The bright spot at the tip of the wick is sufficiently bright that even though the light source may be flickering, the intensity remains strong enough that the eye sees the resultant glare but cannot see the change in intensity of the spot. At the same time, light shines past the wick and onto the candle body where it is diffused throughout a relatively large volume. The light intensities within the candle body are much lower resulting in a dramatic, flickering effect.

For standalone imitation candles that are not housed in a permanent fixture, the approach of the '075 application is more difficult to effect since there is no convenient place to hide the LED but within the candle body itself. An approach to creating a realistic illusion of a flame that does not require a permanent fixture is disclosed in U.S. patent application Ser. No. 11/053,397, filed 31 Mar. 2005 (now U.S. Pat. No. 7,360,935 and assigned to the assignee of the present application), which is incorporated herein by reference. This application discloses an LED hidden within an imitation candle body as in the '308 patent. One end of a fiber optic wick is positioned in close proximity to the LED and captures part of the emitted light. The captured light is directed to the upper, exposed end of the fiber optic wick which then glows brightly in response. The majority of the length of the artificial wick is covered by a dark material, so the overall visual effect is that of a real wick, the tip of which is glowing brightly. The candle can be viewed from the side or above without revealing any light sources or artificial structures that detract from the candles realism.

While the approach described in the '397 application is effective, it may be desirable to produce a light intensity at the tip of the wick that is even brighter than that which can be achieved using a fiber optic wick to transmit a portion of the light emitted by the LED. It would be desirable to place the light source at the tip of the wick for maximum brightness while at the same time incorporating the light source and its support structure into an artificial wick that does not detract from the candle's realism when the candle is viewed from the side or from above.

The present inventors are familiar as well with a decorative, miniature Christmas tree, which is constructed from wires which terminate in surface mount technology light emitting diodes. The wires are soldered to the SMT LEDs, which are scattered about the tree producing the effect of a fully lighted tree.

SUMMARY OF THE INVENTION

According to the invention there is provided an imitation candle having a body and an imitation wick. The imitation wick extends outwardly from the body and supports a light emitting diode on its exposed portion at a location spaced from the body of the imitation candle. An energization circuit for the light emitting diode is housed within the body and electrical leads extend from the energization circuit along the imitation wick for connection to the light emitting diode.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
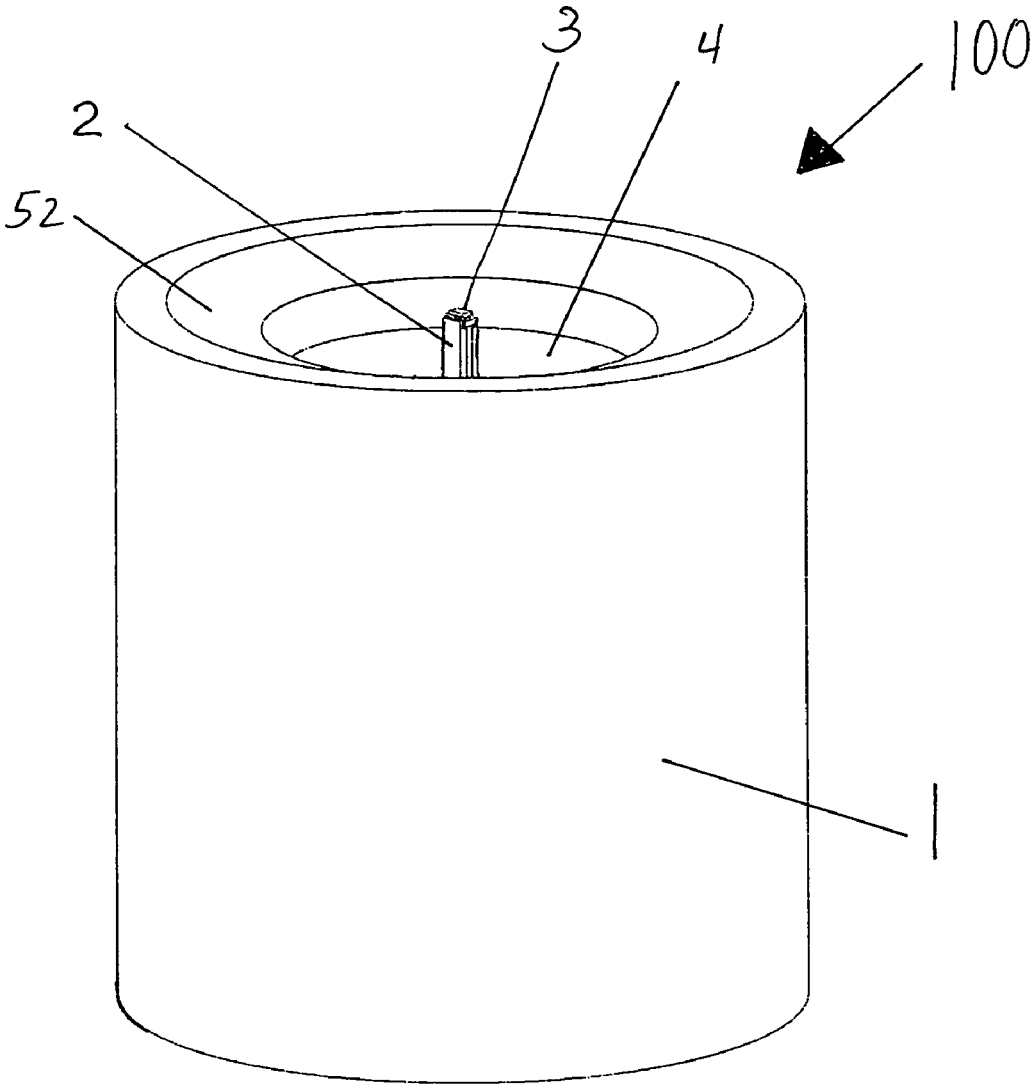
FIG. 1 is a perspective view of an imitation candle.

Referring to FIG. 1 an exterior configuration for several possible embodiments of the imitation candle 100 of the invention is illustrated in perspective view. Imitation candle body 1 is preferably squat, configured to resemble a self supporting candle which has burned down by the center. Imitation candle body 1, which can be fabricated in wax or translucent plastic, may contain an internal light source positioned within the imitation candle body so as to illuminate the candle body with a diffuse, flickering glow that simulates the appearance of a lit candle. An artificial wick 2 extends from the upper surface of candle body 1 and both supports, and provides electrical connections to, an external light source 3, typically a super bright surface mount light emitting diode (LED). A depression 4 in the upper surface 52 of the candle body 1 may be incorporated to simulate a candle that has been partially burned. The part of artificial wick 2 below the external light source 3 may be painted black or enclosed within a thin black sleeve (not shown) to better simulate the appearance of a burnt wick.

Figure 2:
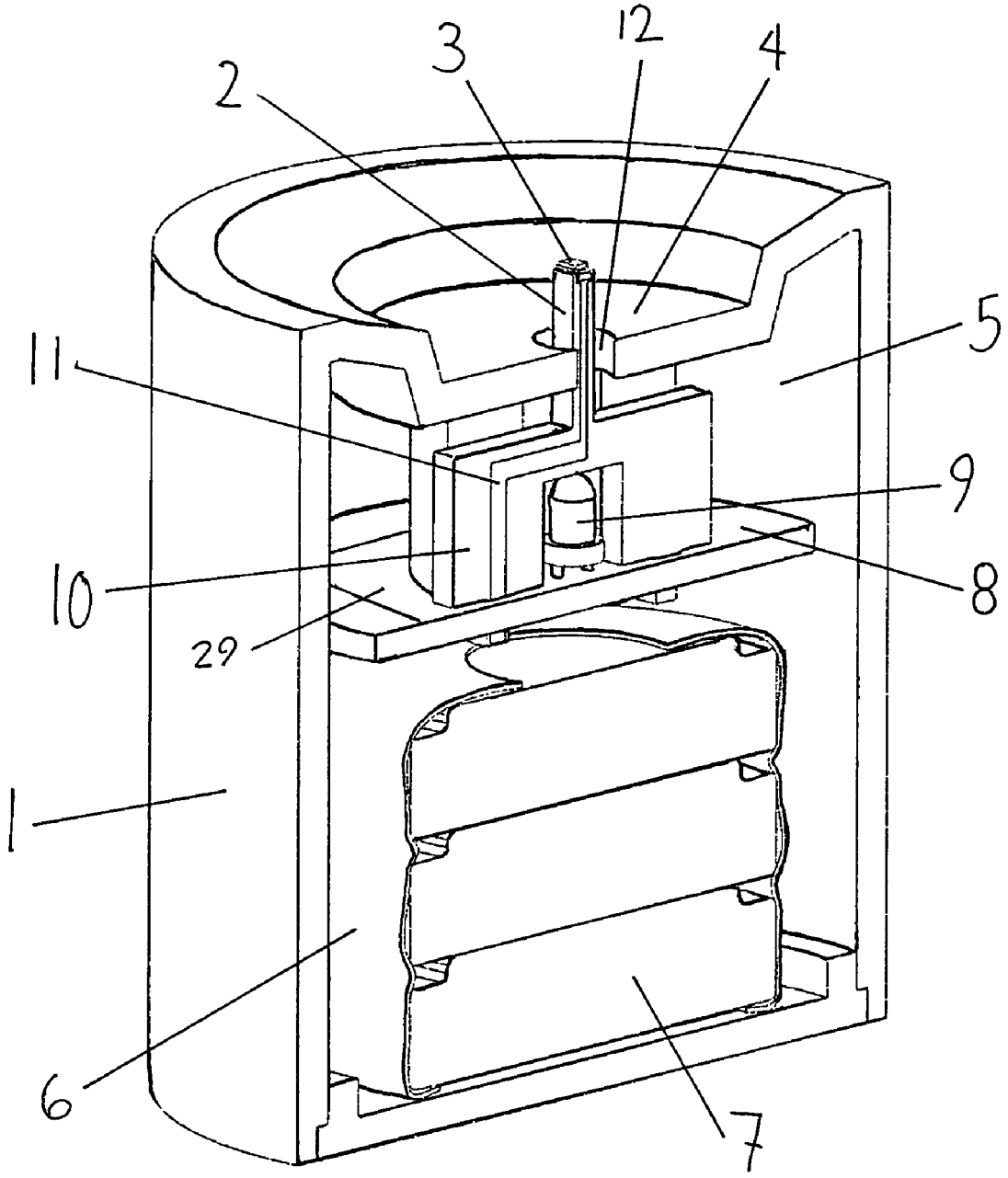
FIG. 2 is a cross sectional view of a possible internal configuration for the imitation candle of FIG. 1.
Figure 3:
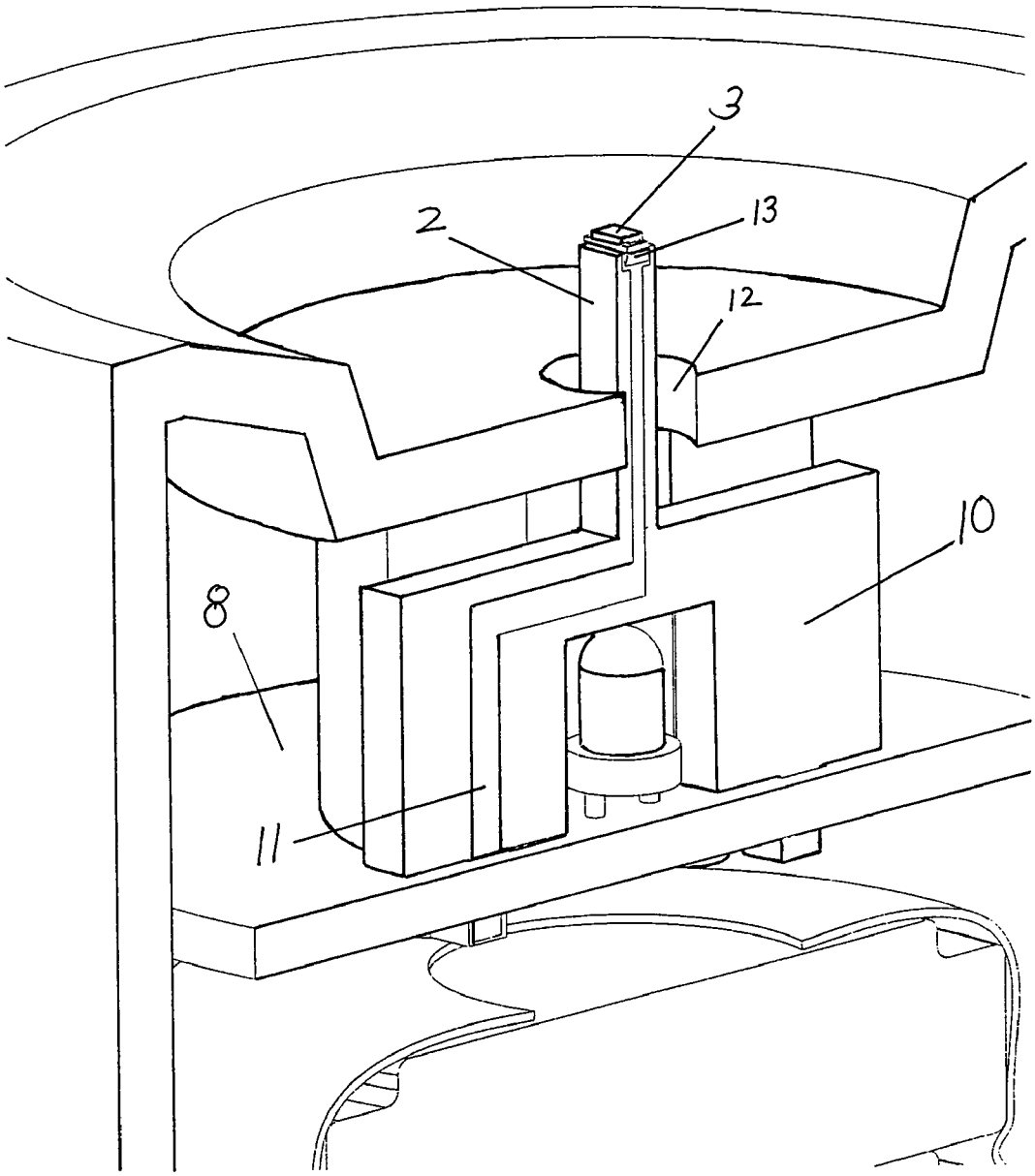
FIG. 3 is a close up view of the lighting element of the internal configuration shown in FIG. 2.

FIGS. 2 and 3 show cross-sectional views of the imitation candle of FIG. 1 illustrating a possible internal configuration thereof. A cavity 5 within the imitation candle body 1 allows space for the installation of an electronics module and a power source 6. The power source 6 would typically include one or more batteries 7, but could also be a connection and conversion assembly to an external source of power. A main circuit board 8 would contain the electronics module 29 needed to supply current to an internal light source 9 and the external light source 3. The external light source 3 is a surface mount light emitting diode which is located mounted face up and flat on a narrow end edge 23 of the imitation wick 2. The surface mount light emitting diode, when illuminated, emits light at the tip of the wick that is undiminished in intensity to an observer. The position of the light source 3 is such that emitted light thus may be directly observed to the sides and from above and a light emitting diode is preferred. The light source 3 and its support structure are incorporated into the imitation wick 2 in a way intended to not detract from the imitation candle's realism when the imitation candle is viewed from the side or from above.

While a cordless model is preferred, it is possible to provide external energization to the device. An internal light source 9 is provided, preferably using a super bright light emitting diode (LED) as described in U.S. Pat. No. 6,616,308, but it could be an incandescent source. External light source 3 is preferably a surface mount technology (SMT), super bright, light emitting diode (LED). In addition to supplying current to the light sources 3 and 9, electronics module 29 may include on/off timers, daylight sensors and a flicker energization circuit to cause either the light source 3, 9 or both, to flicker as would an unstable candle flame.

The size and position of main circuit board 8 is chosen to control the illumination levels from top to bottom of the imitation candle body 1, reducing light emission from the lower portion of the body. A secondary circuit board 10 is mounted along one of its edges to the upper surface of main circuit board 8. Secondary circuit board 10 provides conductive traces 11 to supply current to the external light source 3 along a narrowed section of the secondary board which serves an imitation wick 2. The artificial wick 2 is a narrowed section of the secondary circuit board 10 and passes through a hole 12 in the upper surface of the candle body 1. Hole 12 would typically be filled with a small, insulating plug (not shown) to provide mechanical support for the artificial wick 2. A dark colored, opaque sleeve (described below) would typically surround the exposed portion of artificial wick 2 serving to disguise the artificial wick 2 and give it the appearance of a real wick which has burned down. Alternatives to the sleeve could be used to disguise artificial wick 2 as a wick, but care must be taken not to interfere with light emission from the external light source 3.

FIG. 3 is a close up view illustrating the mounting of a single SMT LED 3 to the artificial wick 2 of the secondary circuit board 10. The secondary circuit board 10 is double sided and has conductive traces 11 on both sides. The LED is mounted to the narrow end edge 23 of the circuit board and soldered 13 on each of two sides to the conduction traces 11 to hold the LED in place and to make electrical connection with the conductive traces 11. Soldering may be used to provide electrical connection between the main circuit board 8 and the traces 11.

Figure 4:
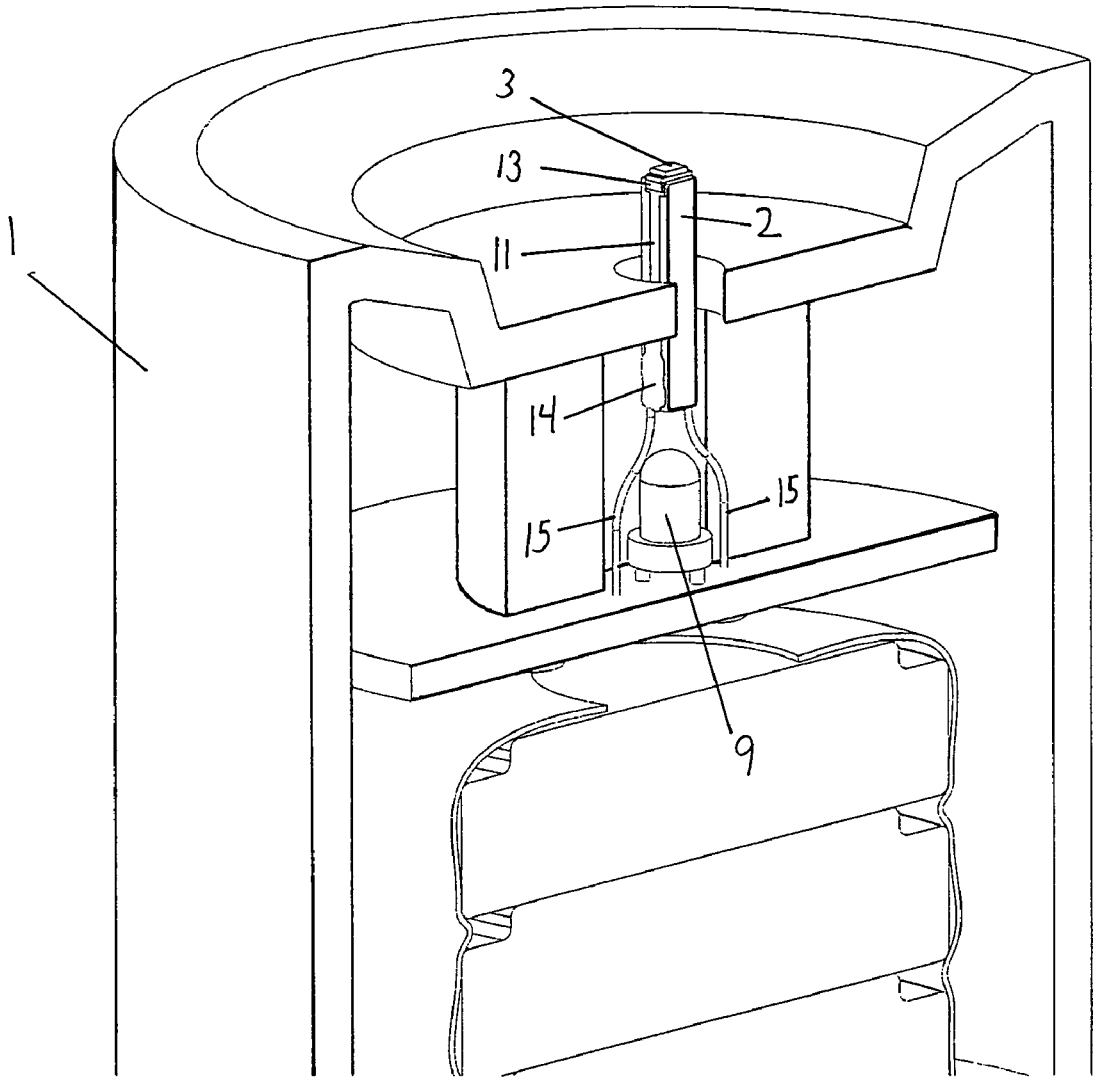
FIG. 4 is a cross sectional view of an alternative internal configuration for a lighting element in accordance with a second embodiment of the imitation candle of FIG. 1.

FIG. 4 shows an alternate embodiment supporting a single SMT LED 3. The secondary circuit board 10 is reduced in size and is connected to the main circuit board 8 with two wires 15 which are soldered 14 to the conductive traces 11 on the secondary circuit board 10. The LED 3 is attached as before. By eliminating most of the secondary circuit board 10 the potential for shadowing a portion of candle body 1 from light emitted by LED 9 is reduced, though in practice, this has proven a minor advantage. In all of the embodiments of the invention provision of a candle body 1 outer wall of sufficient thickness operates to distribute light around the circumference of the body.

Figure 5:
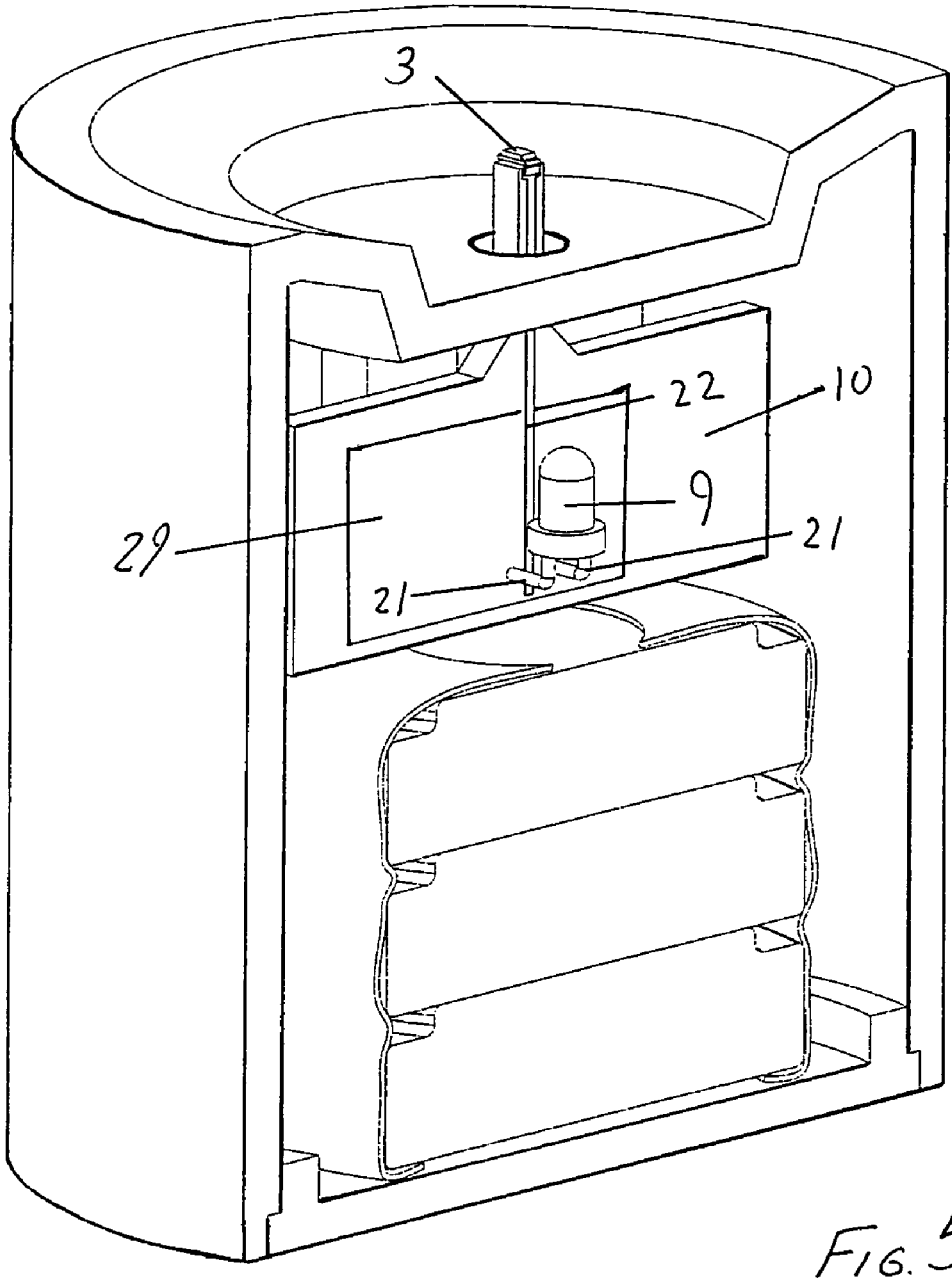
FIG. 5 is a cross sectional view of still another alternative internal configuration for a lighting element in accordance with a third embodiment of the imitation candle of FIG. 1.

FIG. 5 shows an alternate construction that eliminates the need for the main circuit board. The electronics module 29 and the internal light source 9 are all mounted to the secondary circuit board 10. LED 9 is supported on wires 21 extending from Board 10. Conductive traces 22 supply power to LED 3.

Figure 6:
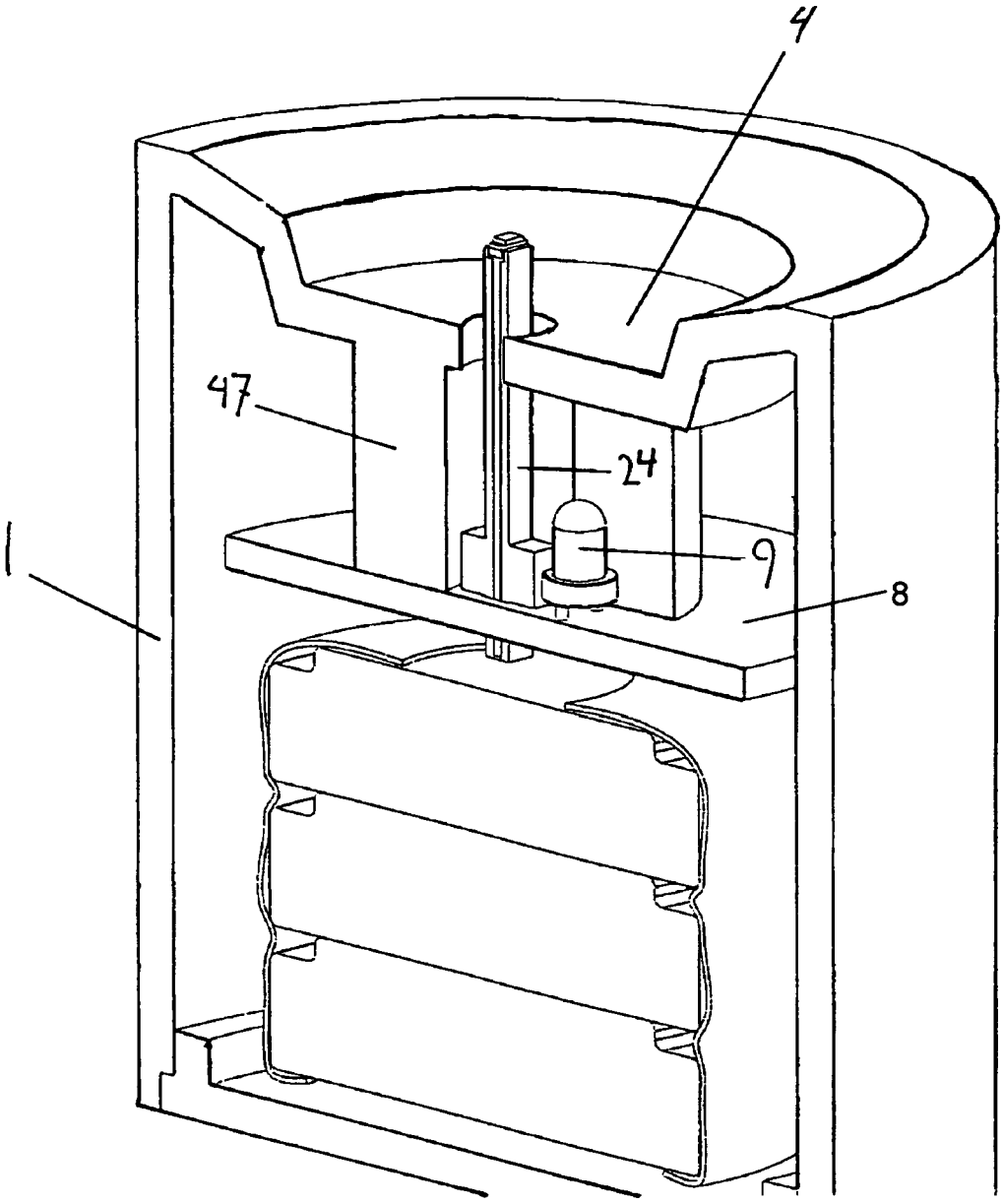
FIG. 6 is a cross sectional view of yet another alternative internal configuration for a lighting element in accordance with a fourth embodiment of the imitation candle of FIG. 1.

FIG. 6 shows an alternate embodiment that significantly reduces the size of the secondary circuit board 24. The internal light source 9 is slightly offset on the main circuit board 10, but not so much as to cause any significant irregularity in illumination of the surrounding candle body. LED 9 is positioned within a cylindrical section 47 made of the same translucent material as the walls of candle body 1, which serves to distribute light evenly outwardly from the LED.

Figure 7:
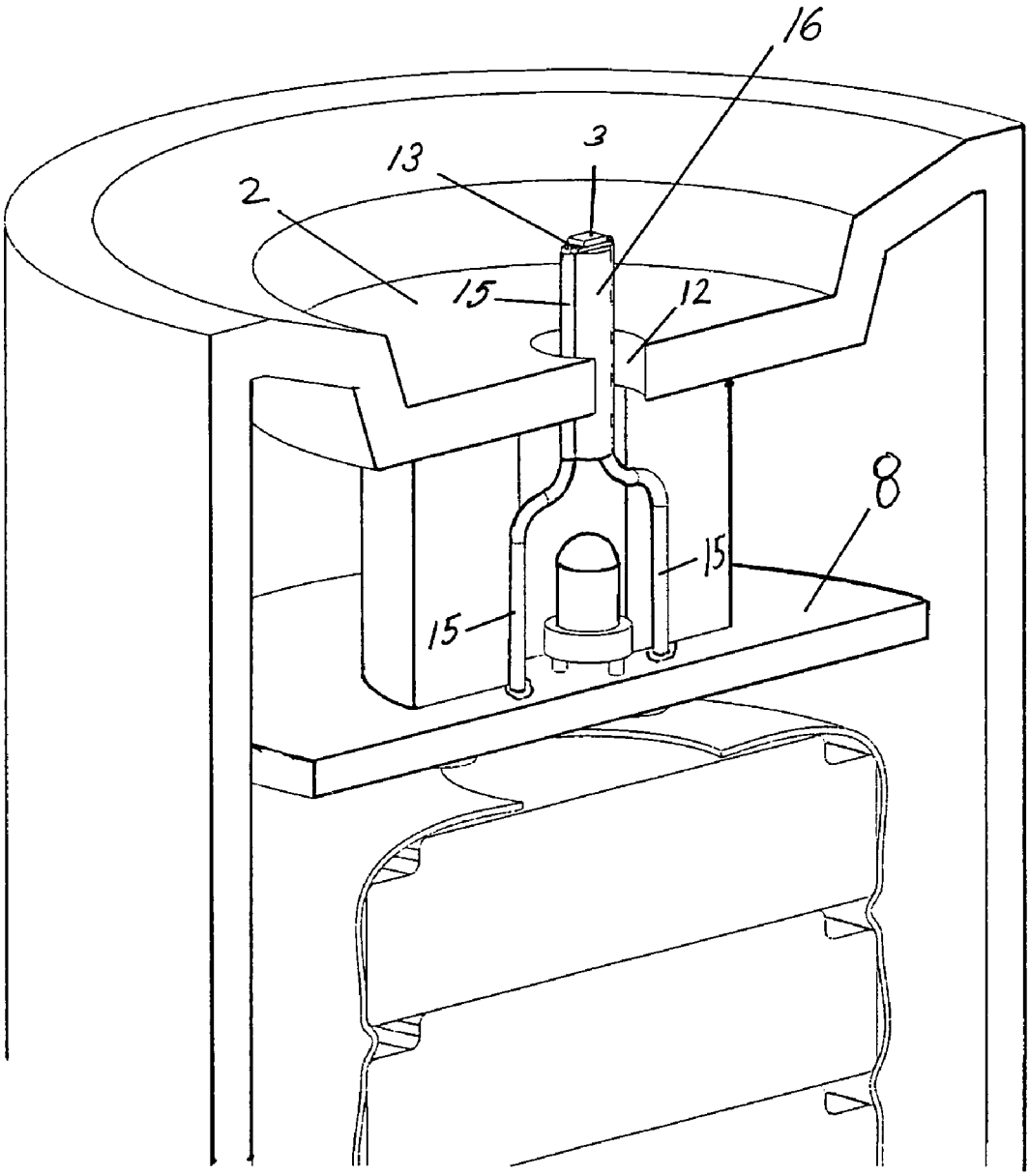
FIG. 7 is a cross sectional view of still another alternative internal configuration in accordance with a fifth embodiment of the imitation candle of FIG. 1.

FIG. 7 shows an alternate embodiment that eliminates the secondary circuit board. Two wires 15 are attached to a plastic rod 16 and to the main circuit board 8. The plastic rod 16 serves to separate the wires 15 and provides mechanical support for the LED 3. The opposite ends of the wires 15 are soldered 13 to the LED 3. A thin sleeve (not shown) helps hold the wires to the plastic rod and provides the appearance of a burnt wick. A plug would fill hole 12 and provide support for the artificial wick 2. The wires 15 could be enameled. The enamel would provide insulation and allow the wires to touch without shorting. The plastic rod 16 would no longer be necessary to keep the wires 15 separated. Twisting enameled wires 15 together to form a twisted pair would provide enough mechanical support for the LED 3, and eliminate the need for the plastic rod 16. A dark sleeve could be used as described before to make the wires look like a real wick, or a dark enamel on the wires 15 could be used to disguise them as a wick.

Figure 8:
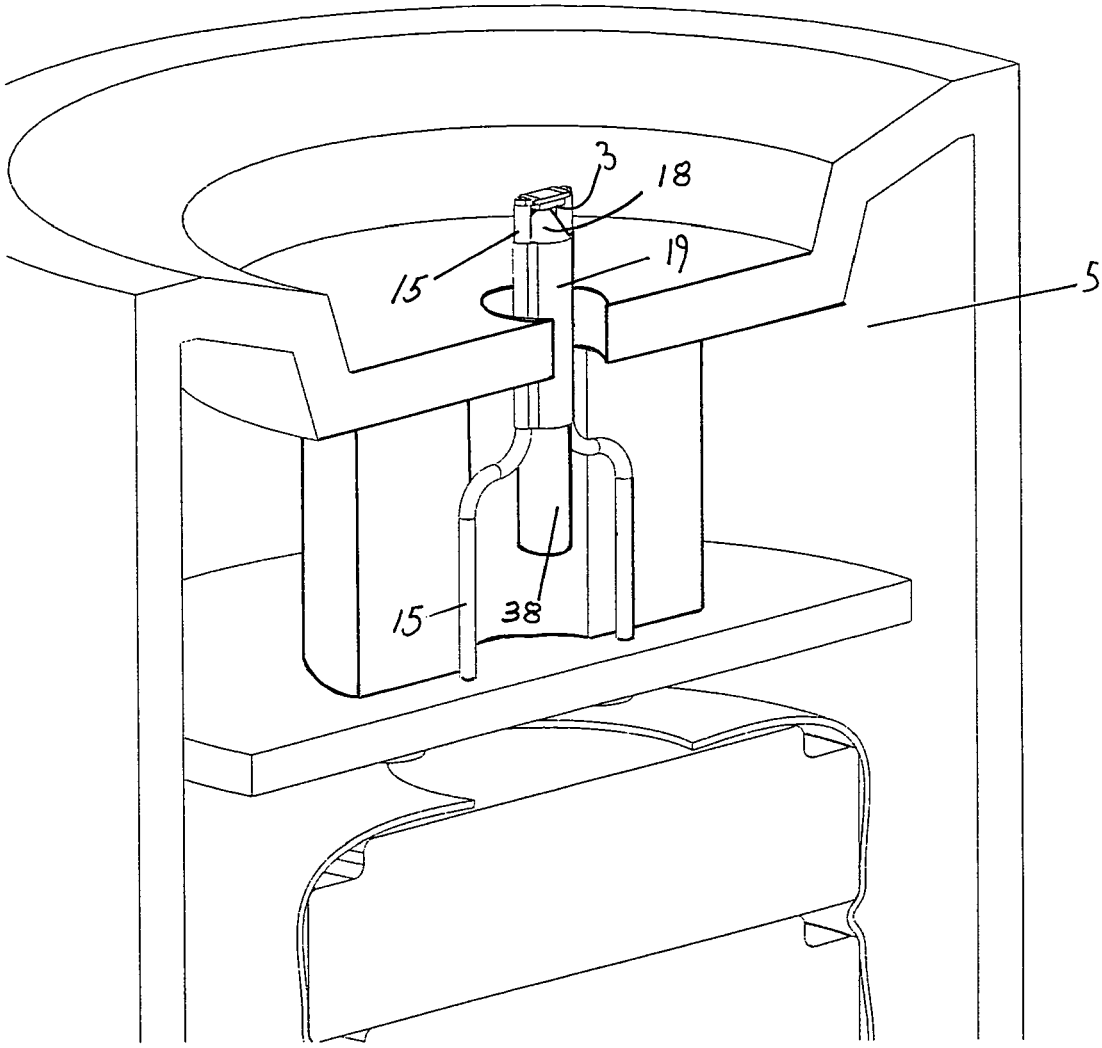
FIG. 8 is a cross sectional view of still another alternative internal configuration in accordance with a sixth embodiment of the imitation candle of FIG. 1.

FIG. 8 shows yet another alternate embodiment that eliminates the secondary circuit board and the internal light source. The LED 3 is mounted inverted with respect to candle body 1 to direct light downward toward a beveled, mirrored tip 18 of rod 38 and toward the upper surface of the candle body 1. The beveled tip 18 reflects light to create the hot spot as required for the desired lighting effect. Spillage from LED 3 illuminates the candle body 1 where light is diffused and appears to cause the candle body 1 to glow from within. A sleeve 19 encloses a portion of rod 38 below beveled tip 18.

Figure 9:
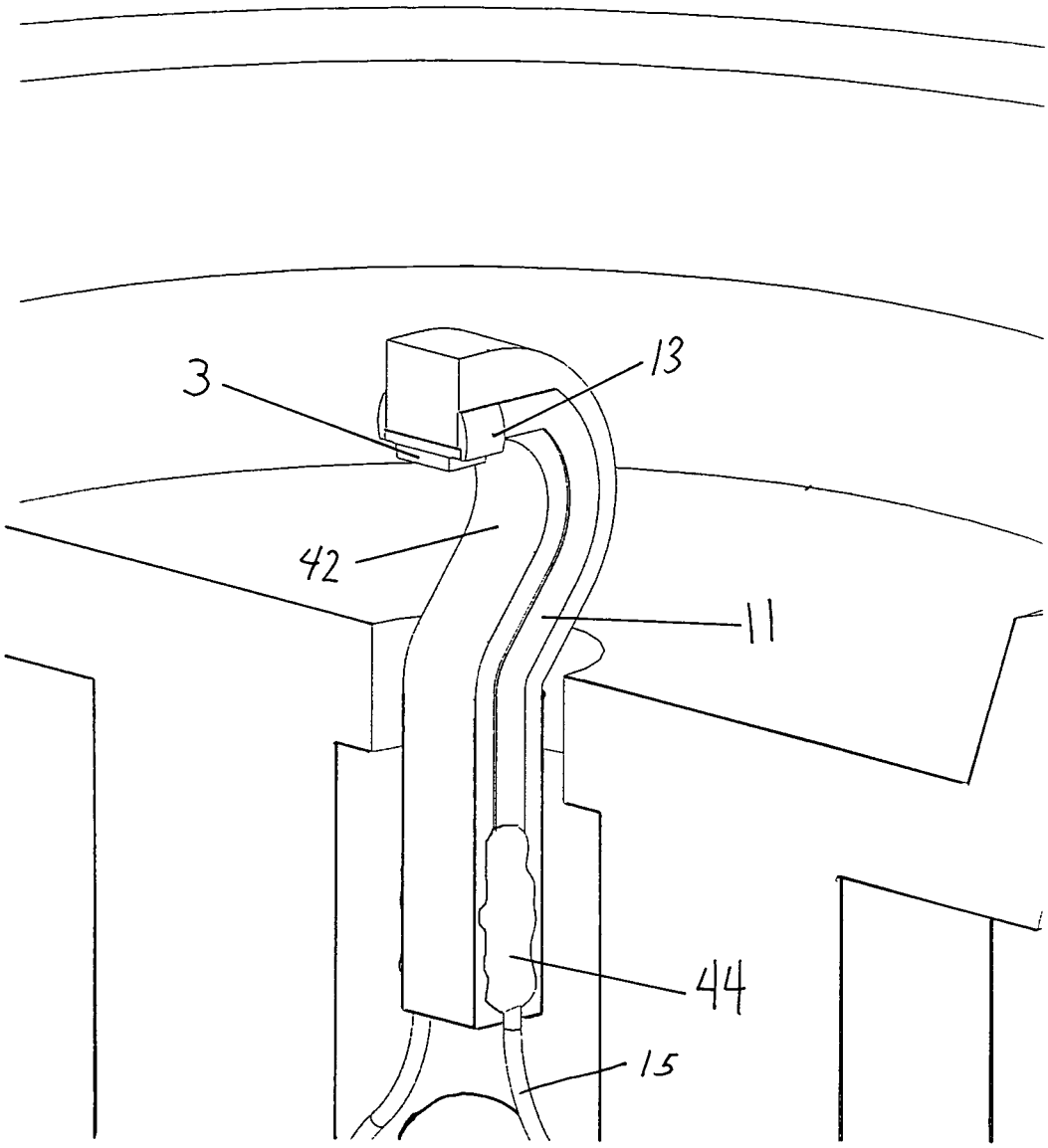
FIG. 9 is a close up view of a downward facing LED mounted to the artificial wick.

FIG. 9 illustrates an LED mounting scheme using a printed circuit board (PCB) 42 that is cut or formed in a hook shape to allow the SMT LED 3 to be mounted facing downward. Printed circuit board carries conductive traces 11 which are electrically connected by solder 44 to wires 15 extending from a main circuit board as shown in FIG. 7.

Figure 10:
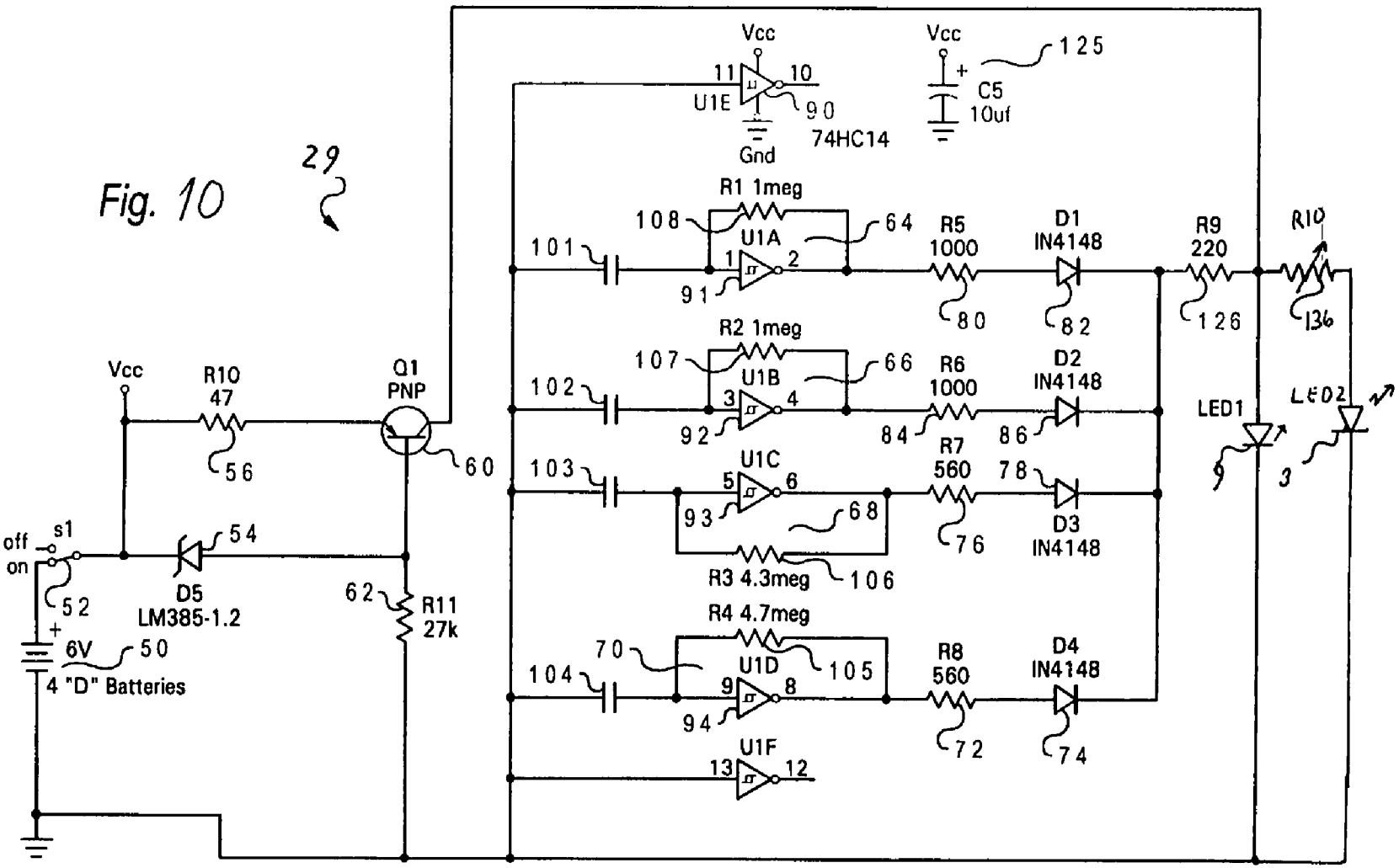
FIG. 10 is a circuit schematic for a representative drive circuit for the LEDs.

FIG. 10 illustrates representative energization electronics 29 for driving a pair of LEDs 3, 9. A power source 50 is provided by four size D batteries. Different power sources can be used depending upon desired battery life or the desired brightness to be obtained from the LED. As mentioned above, alternatives include combinations of solar cells and rechargeable batteries or an outside line source of power. LED 9 is preferably provided in a Global Opto G-L202YTT-T amber light emitting diode package. LED 3 is preferably a G-S160YTT type LED. Energization electronics may be switched on and off using a switch 52 which is attached at one pole to the positive terminal of battery 50. Switch 52 may be a photosensitive device, such a photosensitive transistor. Battery 50 also supplies $V_{cc}$ within energization electronics 29.

LEDs have a constant voltage drop when conducting current and the intensity of light emission from an LED is controlled by varying the current sourced to the LED. Accordingly, the LED energization circuit 29 sources a varying amount of current to LEDs 3, 9. The first major element of energization circuit 46 is a base current source provided by zener diode 54, resistors 56 and 62, and a PNP transistor 60, which sources current to the load, here light emitting diodes 3, 9. The voltage source provided by battery 50 is connected to the transistor 60 emitter by resistor 56 and to the base of the transistor by reverse oriented zener diode 54. The transistor is assured of being constantly biased on by the voltage drop set by the reverse breakdown voltage of zener diode 54 as long as battery voltage remains above the minimum required for zener breakdown operation. Thus transistor 60 sources current to the load through which the current returns to ground. As a result LEDs 3, 9 always produce a minimum level of light output when the device is on.

Variation in light output is effected by variably increasing the current supplied to LEDs 3, 9. A hex inverter, such as a SN74HC14N hex inverter, available from Texas Instruments of Dallas, Tex., is used to implement several parallel oscillators or clocks. All of the oscillators are identically constructed though external component values may be altered. In the preferred embodiment 4 of 6 available inverters (91-94) are used with resistors (105-108) providing feedback from the outputs of the inverters to the inputs. Capacitors 101-104 are connected from the inputs of inverters 91-94 to set the operating frequency of the oscillators. The connection of $V_{cc}$ to the inverters is represented for inverter 90 (U1E) only but is identical for each of inverters 91-94.

The supply of power to the internal LED 9 is described first. Oscillators 68 and 70 are designed to be low frequency oscillators running at approximately 2 Hz. Oscillators 68 and 70, formed using inverters 94 and 93, can use similar timing components to run at approximately a 10% difference in frequency. The 10% difference in frequency prevents oscillators 68 and 70 from synchronizing with each other or drifting past one another too slowly. Low frequency oscillators 68 and 70 provide current to LED 9 through series connected resistors and forward biased diodes 76 and 78, and 72 and 74, respectively, to a summing junction. As a result, current flow through LED 9 is increased from the minimum set by the current source formed by PNP transistor 60 pseudo-randomly. When either of oscillators 68 or 70 is high, it supplies extra current to LED 9 and the LED becomes slightly brighter. When both of oscillators 68 and 70 are high, a third, higher level of current is supplied to the LED 9. The three current levels (both high, only one high, or both low) provide three brightness levels that can be selected by the choice of values for resistors 76 and 72 and the current from the current source. As long as the two oscillators are not synchronized, the three brightness levels will vary in a pseudo-random manner as the oscillators drift. Loose component tolerances are acceptable as contributing to the degree of randomness in current sourced to LED 9. In some applications oscillators 68 and 70 may be set to have as great as a 2:1 variation in frequency. The rate at which the oscillators drift past one another is consequential to the appearance of the luminary.

In the preferred embodiment oscillator 66, formed using inverter 92, operates at about 8 Hz. and provides two more current levels. Three parallel current sources allow for a total of six brightness levels. Again the output from the inverter is fed through a series connected resistor 84 and forward biased diode 86 to a summing junction and then by resistor 126 to LED 9. The value chosen for resistor 84 is higher than for resistors 78 and 74 with the result that oscillator 66 makes a smaller current contribution to LED 9 than oscillators 68 and 70. This contributes still more to the impression of randomness in the light output of LED 9 by providing that changes in light output occur in differing sized steps. Oscillator 64, formed using inverter 91, is also set to run at about 8 Hz. The resistance of resistor 80 is comparable to that of resistor 84 so that oscillator 64 contributes a current comparable to the current supplied by oscillator 66. The current from inverter 91 is routed to LED 9 by resistor 80 and diode 82 to the summing junction and than by resistor 126. A capacitor 125 may be connected between $V_{cc}$ and ground to short circuit noise to ground preventing circuit noise from causing the oscillators to synchronize with one another.

As shown, two of the gates of the hex inverter are not used, but these gates could be used to create two more oscillators with outputs driving additional candles using multiple LEDs or supplying additional current levels to a single LED.

The externally mounted LED 3 is intended to be driven less hard than an internal LED 9 and is connected to the output of the summing junction fed by resistor 126 and PNP transistor 60. Luminosity of LED 3 may be determined by varying the resistance of a resistor 136, if desired, which operates as a voltage divider assuring that LED 3 luminesces at a lower level than does LED 9. Swapping the positions of the LEDs changes which gives off more light.

While the invention is shown in only a few of its forms, it is not thus limited but is susceptible to various changes and modifications without departing from the spirit and scope of the invention.

What is claimed is:

1. An imitation candle comprising:

a body having a internal cavity;

an imitation wick extending outwardly from the cavity in the body through a surface to define the surface as an upper surface of the body, the imitation wick supporting electrical leads along a portion of its length from within the cavity through the upper surface, and the imitation wick having an end tip spaced from the upper surface and located above the body when upright to expose the end tip to direct view from around the body laterally; and a surface mount light emitting diode placed on the imitation wick and connected to the electrical leads, the surface mount light emitting diode being oriented to expose an upper surface and laterally to expose its edges to direct view so that light is emitted from the end tip of the imitation wick by energization of the surface mount light emitting diode.

2. An imitation candle as claimed in claim 1, further comprising:

conductive paths extending along the imitation wick for connection to the surface mount light emitting diode.

3. An imitation candle as claimed in claim 2, further comprising:

electrical energization circuitry located in the cavity and connected by the conductive paths to the surface mount light emitting diode.

4. An imitation candle as claimed in claim 3, further comprising:

the body being translucent;

a second light emitting diode coupled to the electrically energization circuitry and located in the cavity within the body under the upper surface and substantially vertically opposite to the surface mount light emitting diode supported on the imitation wick.

5. An imitation candle as claimed in claim 4, further comprising:

the electrical energization circuitry connected to the surface mount light emitting diode and to the second light emitting diode being configured for supplying differing drive currents to the surface mount light emitting diode and to the second light emitting diode diodes, as well as for varying the drive currents.

6. An imitation candle as claimed in claim 3, further comprising:

a main circuit board located in the cavity, the electrical energization circuitry being disposed on the main circuit board; and a secondary circuit board set upright on the main circuit board and having a narrowed section serving as the imitation wick.

7. An imitation candle as claimed in claim 3, further comprising:

a circuit board located in the body, the electrical energization circuitry being disposed on the circuit board; and the imitation wick comprising a pair of wires extending from the circuit board through the upper surface.

8. An imitation candle as claimed in claim 3, further comprising:

a circuit board disposed vertically in the body and having a narrowed, upwardly extending section serving as the imitation wick; and the electrical energization circuitry being disposed on the secondary circuit board.

9. An imitation candle as claimed in claim 3, further comprising:

the imitation wick supporting the surface mount light emitting diode in an inverted position relative to the body with its major light emitting face oriented toward the upper surface, with a portion of the wick including a mirror positioned between the surface mount light emitting diode and the body and oriented to reflect light emitted by the surface mount light emitting diode laterally outwardly from the imitation wick.

10. An imitation candle as set forth in claim 3, the upper end of the imitation wick being curved allowing the surface mount light emitting diode to be supported oriented downwardly toward the upper surface of the body.

11. An imitation candle as claimed in claim 3, the imitation wick further comprising:

a rod extending from the cavity through the upper surface leaving one end thereof exposed from the body; and a pair of wires attached to the rod to provide the electrical connections.

12. A luminary comprising:

a body configured to have a defined vertical orientation and an upper surface;

a cavity within the body under the upper surface;

an electronics module located in the cavity;

a surface mount light emitting diode;

a support structure extending from the cavity through the upper surface exposing an upper portion of the support structure, the upper portion of the support structure ending in the surface mount light emitting diode; and the surface mount light emitting diode being in contact with electrical connectors to receive energization for light emission, the surface mount light emitting diode being located on the support structure so that light appears to be emitted from a portion of the support structure when the surface mount light emitting diode is energized and above the upper surface when the body is positioned upright and spaced from the upper surface to emit light fully around the body laterally.

13. A luminary as set forth in claim 12, further comprising:

the support structure including a segment of a circuit board having opposite major surfaces and a plurality of edges;

the exposed portion of the support structure comprising an exposed section of the circuit board which is reduced in its lateral dimensions to resemble a candle wick; and the electrical connections being disposed on the opposite major surfaces of the segment of the circuit board.

14. A luminary as set forth in claim 13, further comprising:

the exposed portion of the support structure being shaped to provide an inverted edge facing the upper surface, the surface mount light emitting diode being mounted on the inverted edge.

15. A luminary as set forth in claim 13, further comprising:

a main circuit board supporting the electronics module on a major surface thereof; and the support structure being mounted perpendicular to and on the major surface of the main circuit board.

16. A luminary as set forth in claim 12, further comprising:

the support structure supporting the surface mount light emitting diode in an inverted position oriented to emit light toward the body, a reflecting portion of the exposed portion of the support structure being proximate to and facing the surface mount light emitting diode, the reflecting portion having a mirror finish angled relative to the emitting surface of the surface mount light emitting diode.

17. A luminary as set forth in claim 12, further comprising:

the body being translucent.

18. A luminary as set forth in claim 17, further comprising:

a light source located within the cavity to illuminate the body from within; and the light source being electrically connected to the electronics module for energization to emit light.

19. A luminary as set forth in claim 18, further comprising:

the electronics module providing for energizing the surface mount light emitting diode and the light source synchronously and including a variable current divider allowing the luminosity of the light emitting diode and the light source to be adjusted relative to one another.

20. A luminary as set forth in claim 12, the support structure further comprising:

a rod extending from the cavity through the upper surface leaving one end thereof exposed from the body;

a pair of wires attached to the rod to provide the electrical connections.

* * * * *